US008446324B2

(12) United States Patent
Yukimoto et al.

(10) Patent No.: US 8,446,324 B2
(45) Date of Patent: May 21, 2013

(54) ANTENNA DEVICE

(75) Inventors: Shinsuke Yukimoto, Tokyo (JP); Takao Yokoshima, Tokyo (JP)

(73) Assignees: Mitsubishi Cable Industries, Ltd., Tokyo (JP); Mitsubishi Materials Corporation, Tokyo (JP)

( * ) Notice: Subject to any disclaimer, the term of this patent is extended or adjusted under 35 U.S.C. 154(b) by 323 days.

(21) Appl. No.: 12/992,482

(22) PCT Filed: May 11, 2009

(86) PCT No.: PCT/JP2009/002050

§ 371 (c)(1),
(2), (4) Date: Dec. 30, 2010

(87) PCT Pub. No.: WO2009/139144

PCT Pub. Date: Nov. 19, 2009

(65) Prior Publication Data

US 2011/0187622 A1 Aug. 4, 2011

(30) Foreign Application Priority Data

May 13, 2008 (JP) ..... 2008-126005

(51) Int. Cl.
*H01Q 1/38* (2006.01)

(52) U.S. Cl.
USPC ..... 343/700 MS; 343/846; 343/848

(58) Field of Classification Search
USPC ..... 343/700 MS, 829, 846, 848
See application file for complete search history.

(56) References Cited

U.S. PATENT DOCUMENTS 6,097,339 A * 8/2000 Filipovic et al. ..... 343/702
6,639,559 B2 * 10/2003 Okabe et al. ..... 343/700 MS
6,753,815 B2 * 6/2004 Okubora et al. ..... 343/700 MS
6,906,669 B2 * 6/2005 Sabet et al. ..... 343/700 MS
6,937,193 B2 * 8/2005 Hendler et al. ..... 343/700 MS
7,642,969 B2 * 1/2010 Nam ..... 343/702

FOREIGN PATENT DOCUMENTS

| | | | |
|---|---|---|---|
| JP | 8-130786 | A | 5/1996 |
| JP | 2001168625 | A | 6/2001 |
| JP | 2005-109609 | A | 4/2005 |
| JP | 2007-068115 | A | 3/2007 |
| JP | 2007-267363 | A | 10/2007 |
| JP | 2007-312004 | A | 11/2007 |
| JP | 2008-011281 | A | 1/2008 |

OTHER PUBLICATIONS

International Search Report mailed Aug. 11, 2009 for International application No. PCT/JP2009/002050.
Notice of Refusal issued on Mar. 12, 2013 in corresponding Japanese patent application No. 2008-126005.

* cited by examiner

*Primary Examiner* — Tho G Phan
(74) *Attorney, Agent, or Firm* — Carter, DeLuca, Farrell & Schmidt LLP

(57) ABSTRACT

Provided is an antenna device with which the degradation of characteristics arising from the fact that the antenna has been miniaturized and made thinner is reduced and in which it is possible to increase the gain and to widen the coverage area by improving the characteristics of the internal antenna. The device is equipped with a circuit board, a wireless circuit component which is mounted on the substrate, an internal antenna which is connected to the wireless circuit component which is mounted on the substrate, a circuit-side ground pattern which is connected to the wireless circuit component which is mounted on the substrate, and a dedicated antenna ground paten which is connected to the internal antenna which is mounted on the circuit board.

6 Claims, 9 Drawing Sheets

ANTENNA DEVICE

BACKGROUND

1. Technical Field

The present invention relates to an antenna device that is suitable for a wireless communication technology such as a keyless operation system for an automobile.

2. Description of the Related Art

Conventionally, antenna devices have been used that have an antenna component, such as a rod antenna and the like, that extends to the exterior in order to carry out wireless communication, such as in a keyless operating system for an automobile. However, in recent years, taking into consideration design characteristics, antenna devices that use an internal antenna have come to be used. However, because the antenna characteristics deteriorate due to the internal antenna accompanying the downsizing of the wireless devices, in Japanese Laid-Open Patent Application No. 2000-114865, for example, mobile communication that attains a high gain by using a hand strap has been proposed.

In this mobile wireless device, an internal antenna element is provided inside the case of the wireless device main body and a hand strap connecting portion in which a conducting ring-shaped hand strap is attached is provided in proximity to the internal antenna element. Thereby, the hand strap connecting portion and the internal antenna element are electromagnetically coupled, and a high gain is thereby obtained.

However, even in the conventional technology described above, the following problems remain.

Specifically, in the case in which a high gain is obtained by using an electromagnetically coupled hand strap, as in the Japanese Laid-Open Patent Application No. 2000-114865, there are the problems that the antenna characteristics become completely dependent on the hand strap, the design of the antenna becomes difficult, and stable antenna characteristics are difficult to attain. In addition, because the hand strap is connected to the ground (GND) of the wireless device, there is the inconvenience that the antenna gain of the internal antenna basically cannot be improved.

For example, as shown in FIG. 18A, in the case in which the wireless device has been downsized, as explained above, the area and volume of the internal antenna 2 on the substrate 1 and the circuit-side ground pattern 4 of the wireless circuit component 3 become small. In contrast, as shown in FIG. 18B, in order to widen the circuit-side ground pattern 4, a method can be considered in which the strap holder 5 or conducting hand strap 6 is electrically connected with the circuit-side ground pattern 4. However, because the original circuit-side ground pattern 4 is small, the antenna characteristics are unstable, the characteristics cannot be improved, and there is a concern that the wireless circuit component 3 may be damaged due to the influence of static electricity. Thus, as shown in FIG. 18C of the Japanese Laid-Open Patent Application No. 2000-114865, a method can be considered in which the conductive hand strap 6 and the circuit-side ground pattern 4 are electromagnetically coupled. However, although the problem of static electricity can be improved, the performance of the internal antenna 2 itself cannot be improved, and at the same time, the method is dependent on the condition of the hand strap 6 (the length and the arrangement state and the like), and the antenna characteristics become unstable. In this manner, in the conventional technology, an adequate antenna design and ground pattern design are difficult, and the improvement of the antenna characteristics is a difficult.

In consideration of the problems described above, it is an object of the present invention to provide an antenna device in which the deterioration of characteristics due to downsizing and thickness reduction are decreased, and at the same time, the characteristics of the internal antenna are improved to enable realizing a high gain and broad coverage.

SUMMARY

The present invention uses the following configuration in order to solve the problems described above. Specifically, the antenna device of the present invention is characterized in being provided with a substrate, a wireless circuit component that is provided on the substrate, an internal antenna that is provided on the substrate and is connected to the wireless circuit component, a circuit-side ground pattern that is provided on the substrate and is connected to the wireless circuit component, and a dedicated antenna ground pattern that is provided on the substrate and is connected to the internal antenna.

In this antenna device, because the dedicated antenna ground pattern connected to the internal antenna is provided on the substrate separately from the circuit-side ground pattern, the antenna characteristics such as the antenna gain and the frequency bandwidth and the like are improved by the dedicated antenna ground pattern, which is not dependent on the circuit-side ground pattern of the wireless circuit component. Line capacity is generated depending on the gap between the dedicated antenna ground pattern and the circuit-side ground pattern, and effects such as static electricity countermeasures can be attained.

In addition, the antenna device of the present invention is characterized in that the dedicated antenna ground pattern extends in a direction perpendicular to the direction of the extension of the internal antenna. Specifically, in this antenna device, because the dedicated antenna ground pattern extends in a direction that is perpendicular to the direction of the extension of the internal antenna, in comparison to the case in which the dedicated antenna ground pattern extends in the same direction as the direction of the extension of the internal antenna, the overall length can be shortened, and space saving is possible.

In addition, the antenna device of the present application is characterized in being provided with a metal component that is provided so as to project from the substrate, and the dedicated antenna ground pattern is connected to the metal component. Specifically, in this antenna device, because the dedicated antenna ground pattern is connected to the metal component that projects from the substrate, even in the case in which a sufficient dedicated antenna ground pattern cannot be ensured accompanying the downsizing of the device, the antenna characteristics are improved by the size of the metal component.

Furthermore, the antenna device of the present invention is characterized in that the metal component is a strap holder. That is, in this antenna device, because the metal component is a strap holder, a handle strap can be attached to this strap holder, and not only does this function to improve the antenna characteristics, but it can be used as a strap holder. In addition, even when the handle strap is attached to this metal component, the deterioration of the antenna characteristics and unstable elements can be eliminated. Furthermore, the requirement of conductivity and the like in the attached hand strap is eliminated, and the design characteristics including the strap handle, cost, and productivity are superior.

In addition, the antenna device of the present invention is characterized in that a static electricity countermeasure circuit component is provided between the metal component and the dedicated antenna ground pattern. Specifically, in this antenna device, because the dedicated antenna ground pattern is connected to the metal component through the static electricity countermeasure circuit component, the wireless circuit component and the like can be protected against surges that enter from the metal component by the static electricity countermeasure circuit component.

In addition, the antenna device of the present invention is characterized in that ground adjustment components are provided that are locally connect the dedicated antenna ground pattern and the circuit-side ground pattern at least at one location. Specifically, in this antenna device, because a ground adjustment component is provided that connects the dedicated antenna ground pattern and the circuit-side ground pattern at least at one location, noise countermeasures become possible by arbitrarily setting the arrangement locations of the ground adjustment components, and the stabilization of the dedicated antenna ground pattern and the circuit-side ground pattern can be realized. Thereby, a design that provides noise countermeasures, static electricity countermeasures, and the stabilization of the ground pattern can be established.

According to the present invention, the following effects are attained. Specifically, according to the antenna device of the present invention, because the dedicated antenna ground pattern connected to the internal antenna is provided on the substrate separately from the circuit-side ground pattern, the antenna characteristics such as the antenna gain and the frequency bandwidth and the like are improved by the dedicated antenna ground pattern, which is not dependent on the circuit-side ground pattern of the wireless circuit component. Therefore, deterioration of properties due to downsizing and increasing the thinness of the device can be reduced, and at the same time, a high gain and wide bandwidth can be realized by improving the properties of the internal antenna. The antenna device of the present invention is advantageously used in any of a wireless communication system mounted on an automobile or the like, a receiving antenna device, a transmission antenna device, and a reception and transmission antenna device used in particular in a keyless operation system.

DESCRIPTION OF THE EMBODIMENTS

Below, a first embodiment of the antenna device according to the present invention will be explained with reference to FIG. 1 to FIG. 4. Note that in each of the figures used in the following explanation, the dimensions have been suitably changed to a size that renders each member recognizable or easily understood.

Figure 1:
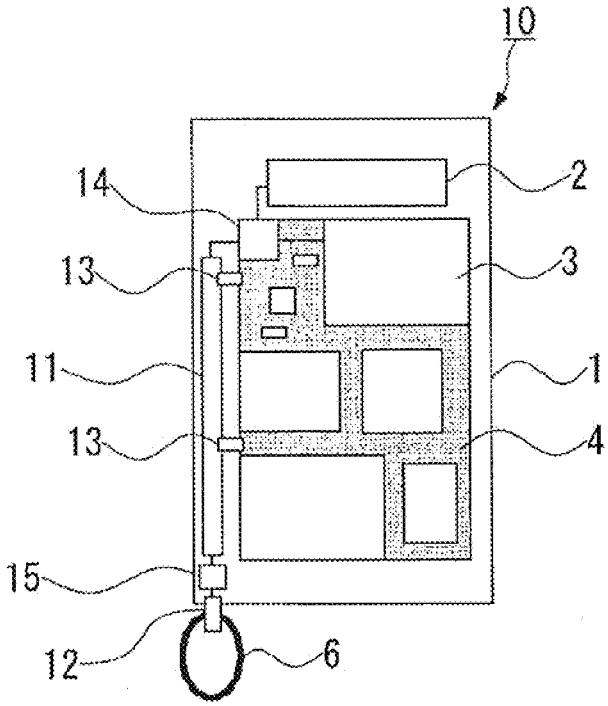
FIG. 1 is a plan view that shows the antenna device in a first embodiment of the antenna device according to the present disclosure.
Figure 2:
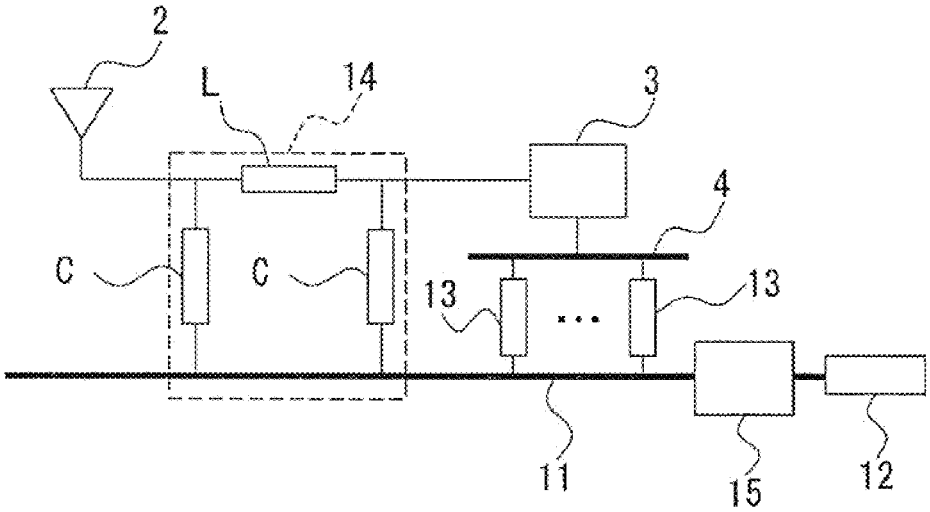
FIG. 2 is an equalization circuit in the antenna device of the first embodiment.
Figure 3:
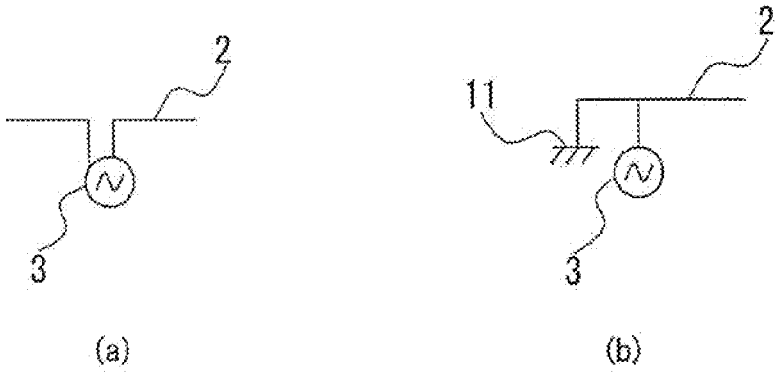
FIG. 3 is an explanatory drawing that shows a dipole antenna and an inverted F antenna as antenna types when there is no matching circuit in the antenna device of the first embodiment.
Figure 4:
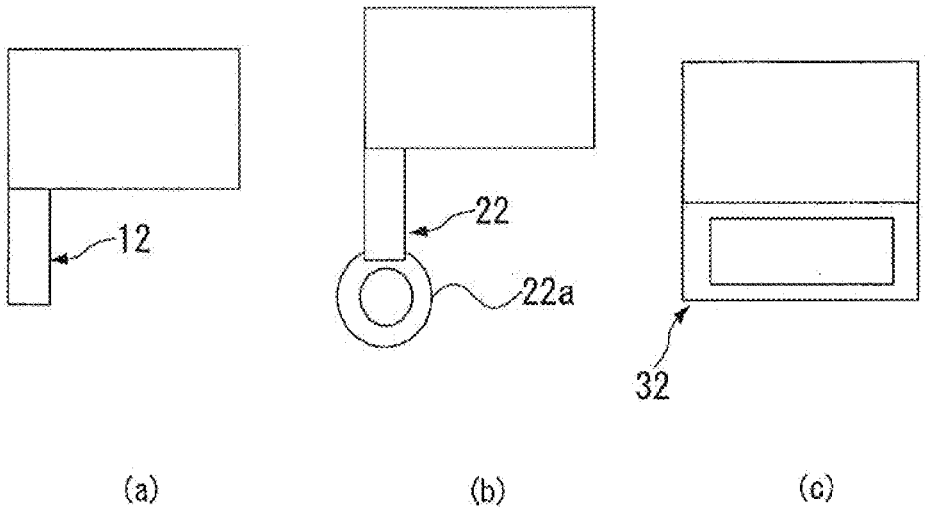
FIG. 4 is a simple enlarged view of the principal components that shows the various profiles of the metal component in the antenna device of the first embodiment.

The antenna device 10 in the present embodiment is a wireless communication system mounted, for example, in an automobile or the like, and in particular, may be a receiving antenna device, a transmitting antenna device, or a receiving and transmitting antenna device used in a keyless operation system. As shown in FIG. 1 and FIG. 2, the antenna device 10 is provided with a substrate 1, a wireless circuit component 3 that is provided on the substrate 1, an internal antenna 2 that is provided on the substrate 1 and is connected to the wireless circuit component 3, a circuit-side ground pattern 4 that is provided on the substrate 1 and is connected to the wireless circuit component 3, a dedicated antenna ground pattern 11 that is provided on the substrate 1 and is connected to the internal antenna 2, a metal component 12 that is provided so as to project from the substrate 1, and ground adjustment components 13 that locally connect the dedicated antenna ground pattern 11 and the circuit-side ground pattern 4 at least at one location.

The dedicated antenna ground pattern 11 and the circuit-side ground pattern 4 are formed, for example, on the substrate 1 by a conducting metal such as a copper foil or the like. Between the internal antenna 2, the wireless circuit component 3, and the dedicated antenna pattern 11, a matching circuit component 14 is provided that has been designed to match the internal antenna 2 and the wireless circuit component 3. This matching circuit component 14 has, for example, as shown in FIG. 2, a circuit structure in which a single stage or multiple stages of a π-type LC circuit, which is formed by a plurality of inductors L and capacitors C, is provided.

Note that a keyless operation system denotes a system in which the lock and unlock operation for the doors and the tailgate of an automobile (what is termed a "keyless entry system") and the startup operation for an engine are enabled by carrying out a check of an ID code between a key and a reception antenna device arranged on the automobile body side by wireless communication when the vehicle is approached within a wireless operation range only by a driver carrying a key having a wireless communication function that is referred to as "keyless operation key".

The power supply line from this matching circuit component 14 is connected to the wireless circuit component 13, and at the same time, a ground line is connected to the dedicated antenna ground pattern 11. Specifically, the internal antenna 2 is connected to the wireless circuit component 3 and the dedicated antenna ground pattern 11 via the matching circuit component 14.

Note that in the present embodiment, in order to provide a matching circuit component 14, it is connected to the dedicated antenna ground pattern 11 from this matching circuit component 14, but there are cases in which, depending on the camera, the design includes the matching circuit component in the antenna. In this case, a similar effect can be attained by using a component that operates as the ground inside the antenna element.

Furthermore, a static electricity countermeasure circuit component 15 that has a surge absorbing function is provided between the metal component 12 and the dedicated antenna ground pattern 11. In this static electricity counteracting circuit 15, a general static electricity countermeasure component such as a varistor or the like is used. The dedicated antenna ground pattern 11 extends linearly in a direction that is perpendicular to the direction of extension of the internal antenna 2. Note that the dedicated antenna ground pattern 11 may attain advantageous characteristics for all characteristics the longer the length of the extension in the direction of the circuit-side ground pattern 4. In particular, the dedicated antenna ground pattern 11 can be set so as to be long by being extended along the longitudinal direction of the antenna device 10.

For the internal antenna 2, for example, a chip antenna that uses, for example, a dielectric or the like, a pattern antenna that is formed by a conducting pattern such as copper foil, or a flat antenna or a helical antenna made of a flat metal can be used. Among these, a chip antenna is preferable because it can be downsized. General passive elements such as resistors, capacitors, inductor or the like are used in these ground adjusting components 13. Note that the ground adjusting components 13 can be provided at arbitrary locations as necessary, and in the present embodiment, the dedicated antenna ground pattern 11 and the circuit-side ground pattern 4 are connected by providing the ground adjusting components 13 at two locations along the dedicated antenna ground antenna 11.

Note that, as case in which the matching circuit component 14 is not used, the present embodiment can also be applied in the case in which a ground pattern, such as a dipole antenna, as shown in FIG. 3A, or a inverted F antenna, as shown in FIG. 3B, functions as a portion of the antenna. In this case, by replacing a ground pattern that acts as an antenna with the dedicated antenna ground pattern 11, the same effect can be attained.

In addition, the metal component 12 may be, as shown in FIG. 4A, a rod shaped strap holder to which the hand strap 6 can be attached through a hole (not illustrated). However, in addition to a rod shape, a variety of shapes can be used. For example, as shown in FIGS. 4B and 4C, a metal component 22 serving as a strap holder having a circular shaped portion 22*a* at the distal end thereof or a metal component 32 serving as a strap holder having an overall rectangular shape and the like may be used.

In such an antenna device 10 of the present embodiment, because a dedicated antenna ground pattern 11 that is connected to the internal antenna 2 is provided on the substrate 1 separately from the circuit-side ground pattern 4, the antenna properties such as the antenna gain and the frequency bandwidth and the like are improved by the dedicated antenna ground pattern 11, which is not dependent on the circuit-side ground pattern 4 of the wireless circuit component 3.

In addition, because the dedicated antenna ground pattern 11 extends in a direction that is perpendicular to the direction of the extension of the internal antenna 2, the overall length can be shortened in comparison to the case in which the dedicated antenna ground pattern 11 extends in the same direction as the direction of extension of the internal antenna 2, and space-saving is thereby possible. Furthermore, because the dedicated antenna ground pattern 11 is connected to the metal component 12 that projects from the substrate 1, even in the case in which a sufficient area of dedicated antenna ground pattern 11 cannot be ensured accompanying the downsizing of the device, the antenna properties are improved due to the size of the metal component 12.

In addition, in the case in which the metal component 12 serves as the strap holder, the hand strap 6 can be installed on this metal component 12, and in addition to the function of improving the antenna properties, the metal component 12 can be used as a strap holder. In addition, even in the case in which the hand strap 6 is attached to this metal component 12, it is possible to eliminate deterioration of the antenna properties and unstable elements. Furthermore, the need for conductivity in the attached hand strap 6 is eliminated, and the design characteristics, cost, and productivity, which that include a hand strap, are superior.

In addition, because the dedicated antenna ground pattern 11 is connected to the metal component 12 via the static electricity counteracting circuit component 15, the internal antenna 2 and the wireless circuit component 3 and the like can be protected from surges that enter from the metal component 12 by the static electricity counteracting circuit component 15.

Note that in the case in which ground adjustment components 13 are not provided, the antenna dedicated ground pattern 11 and the circuit-side ground pattern 4 are separate, the line capacity is generated depending on the gap between the dedicated antenna ground pattern 11 and the circuit-side ground pattern 4, and the effect of static electricity countermeasures can be obtained. Conversely, the case in which the antenna properties and the wireless circuit component 3 will be adversely affected by noise generated by the wireless circuit component 3 due to the separation can be considered, but by providing ground adjustment components 13 that locally connect the dedicated antenna ground pattern 11 and the circuit-side ground pattern 4 at least at one location, noise countermeasures become possible and stabilization of the dedicated antenna ground pattern 11 and the circuit-side ground pattern 4 can be realized. Thereby, a design that provides noise countermeasures, static electricity countermeasures, and stabilization of the ground pattern can be established.

Next, a second to fourth embodiment of the antenna device according to the present invention will be explained with reference to FIG. 5 to FIG. 7. Note that in the explanation of each of the embodiments, identical reference numerals are appended to identical structural components explained in the above embodiment, and the explanations thereof are omitted.

Figure 5:
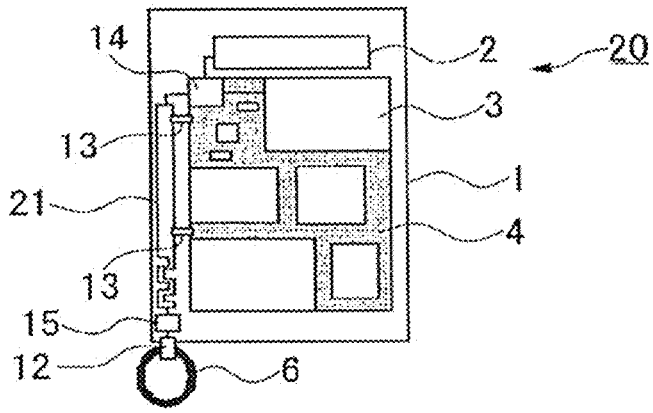
FIG. 5 is a plan view that shows an antenna device in a second embodiment of the antenna device according to the present disclosure.

The point of difference between the second embodiment and the first embodiment is that in the first embodiment, a dedicated antenna ground pattern 11 that extends rectilinearly at a certain width is formed, whereas in the antenna device 20 of the second embodiment, as shown in FIG. 5, a dedicated antenna ground pattern 21 in which an intermediate portion has a meandering profile is formed. Specifically, in the antenna device 20 of the second embodiment, because an intermediate portion of the dedicated antenna ground pattern 21 has a meandering profile, it is possible to obtain a dedicated antenna ground pattern 21 that is longer than the first embodiment, and more advantageous antenna properties can be obtained.

Figure 6:
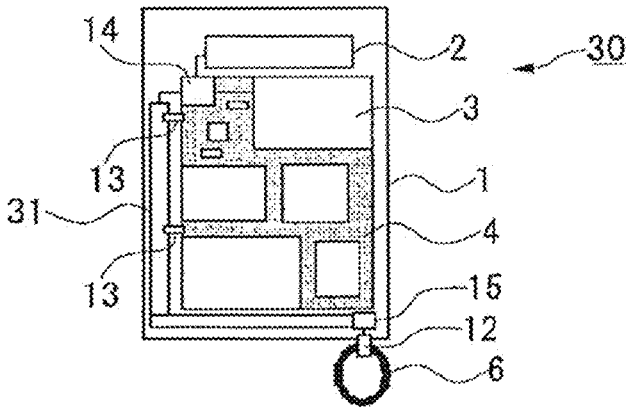
FIG. 6 is a plan view that shows an antenna device in a third embodiment of the antenna device according to the present disclosure.
Figure 7:
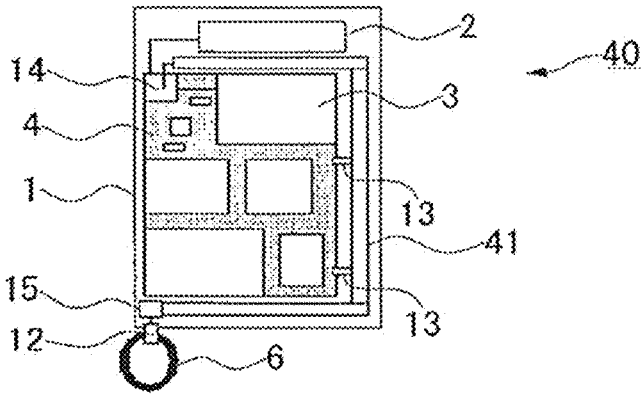
FIG. 7 is a plan view that shows an antenna device in a fourth embodiment of the antenna device according to the present disclosure.

In addition, the point of difference between the third and fourth embodiments and the first embodiment is that in the first embodiment a dedicated antenna ground pattern 11 that extends rectilinearly is formed, whereas in the antenna devices of the third and fourth embodiments 30 and 40, as shown in FIG. 6 and FIG. 7, L-shaped and U-shaped dedicated antenna ground patterns 31 and 41 are respectively formed. Specifically, in the antenna devices 30 and 40 of the third and fourth embodiments, because the dedicated antenna ground patterns 31 and 41 respectively have an L-shape and a square C shape, similar to the second embodiment, dedicated antenna ground patterns 31 and 41 that are longer than that of the first embodiment can be obtained, and more advantageous antenna properties can thereby be obtained.

Next, a fifth embodiment of the antenna device of the present invention will be explained with reference to FIG. 8 and FIG. 9.

Figure 8:
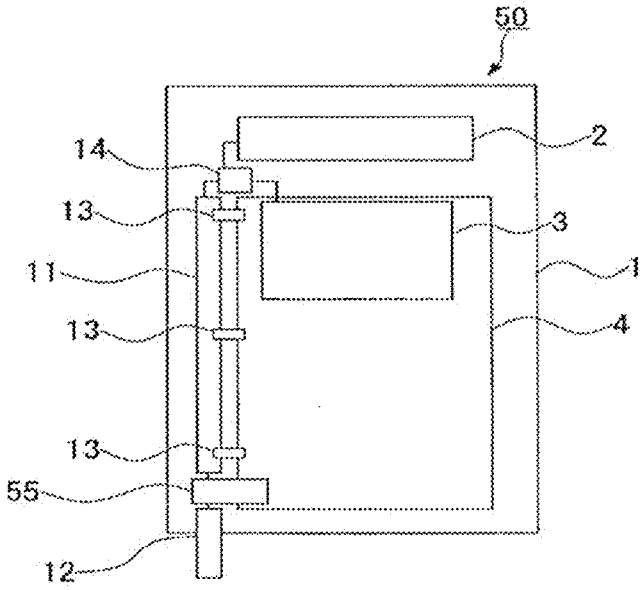
FIG. 8 is a plan view that shows an antenna device in a fifth embodiment of the antenna device according to the present disclosure.
Figure 9:
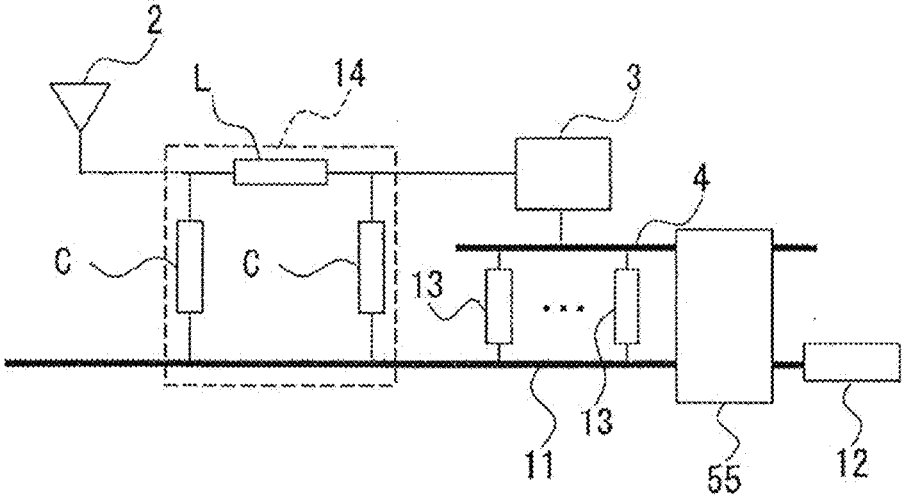
FIG. 9 is an equalization circuit in the antenna device of the fifth embodiment.

The point of difference between the fifth embodiment and the first embodiment is that in the first embodiment the static electricity countermeasure circuit component 15 is connected to the dedicated antenna around pattern 11 and the metal component 12, whereas in the antenna device 50 of the fifth embodiment, as shown in FIG. 8 and FIG. 9, the static electricity countermeasure circuit component 55 is also connected to the circuit-side ground pattern 4. Specifically, in the antenna device 50 of the fifth embodiment, because the static electricity countermeasure circuit component 55 is also connected to the circuit-side ground pattern 4, the static electricity countermeasure circuit component 55 not only protects the internal antenna 2, but also protects the wireless circuit component 3, and thereby the static electricity protection of both becomes possible.

EXAMPLE

Next, the results of measuring actual antenna properties will be shown for the antenna device of the present invention. First, in the antenna device for wireless equipment and the like, the substrate 1 providing a wireless circuit component 3 was designed, and as shown in FIG. 10A, the case (reference state) of the layout of an ideal internal antenna 2 and a circuit-side ground pattern 4 is considered.

Figure 10:
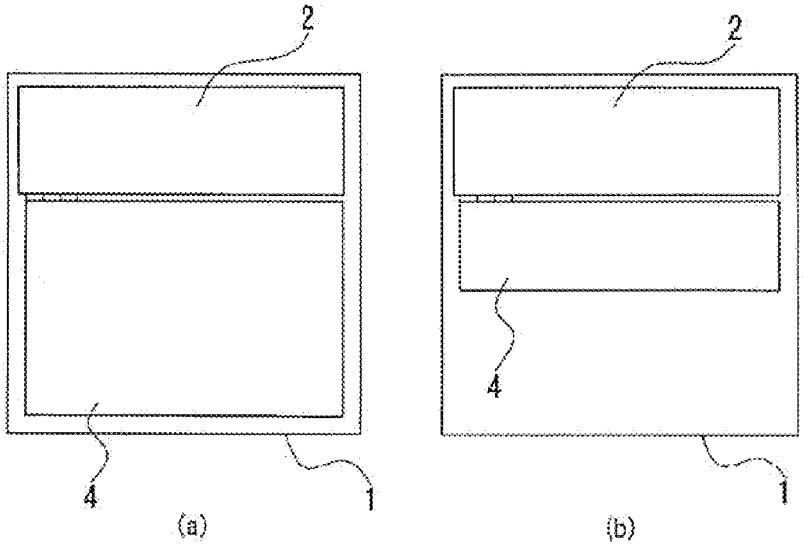
FIG. 10 is a simple plan view that shows the ideal case and the reduced case of the circuit-side ground pattern in a conventional example of the antenna device according to the present disclosure.
Figure 11:
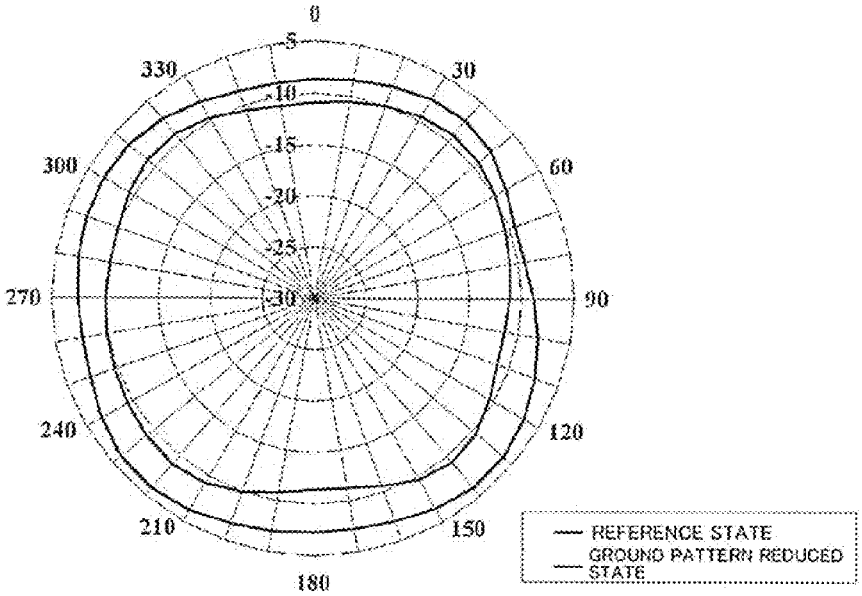
FIG. 11 is a graph that shows the radiation patterns of the ideal case and the reduced case of the circuit-side ground pattern in a conventional example of the antenna device of the present disclosure.

In contrast, as shown in FIG. 10B, it may be thought that the circuit-side ground pattern 4 would actually become smaller due to the component packaging. When this circuit-side ground pattern 4 is in a reduced state, confirming the radiation pattern thereof, as shown in FIG. 11, in comparison to the above ideal case (reference state), it can be understood that the antenna gain deteriorates a maximum of 3 dB. In addition, a bandwidth with a VSWR (voltage standing wave ratio)=3 deteriorates 10% with respect to the ideal case.

Figure 12:
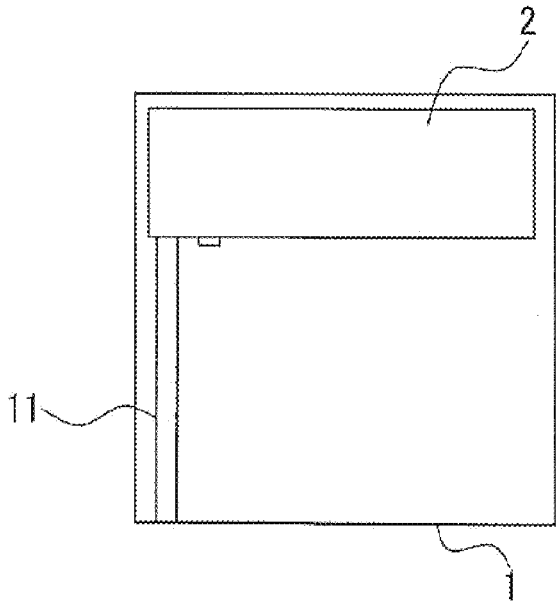
FIG. 12 is a simple plan view that shows the case in which a dedicated antenna ground pattern is added instead of a circuit-side ground pattern in an embodiment of the antenna device of the present disclosure.
Figure 13:
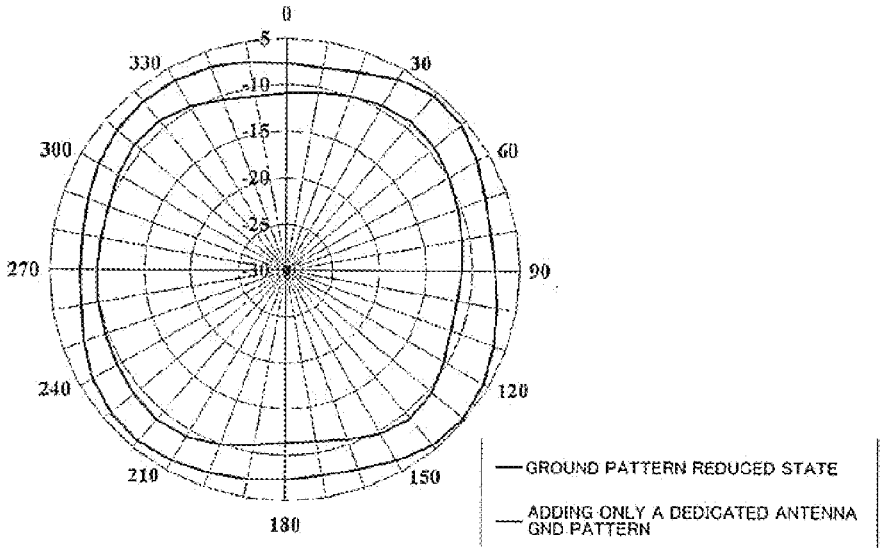
FIG. 13 is a graph that shows the radiation pattern of a conventional example in which a circuit-side ground pattern is reduced and an embodiment in which a dedicated antenna ground pattern is added instead of a circuit-side ground pattern in a conventional example and an example of the antenna device according to the present disclosure.

In contrast to these conventional examples, as shown in FIG. 12, consider the example of the present invention in which the circuit-side ground pattern 4 is eliminated and the dedicated antenna ground pattern 11 is added. As a result, as shown in FIG. 13, in comparison to the state in which the conventional circuit-side ground pattern 4 is reduced (GND pattern reduction state), it is understood that both the antenna gain and the bandwidth are improved.

Figure 14:
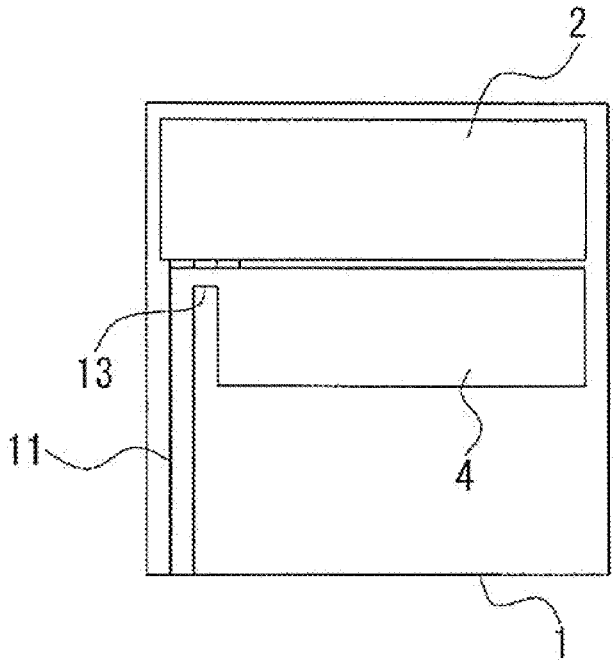
FIG. 14 is a simple plan drawing that shows the case in which a dedicated antenna ground pattern is added when the circuit-side ground pattern is reduced in an embodiment of the antenna device of the present disclosure.
Figure 15:
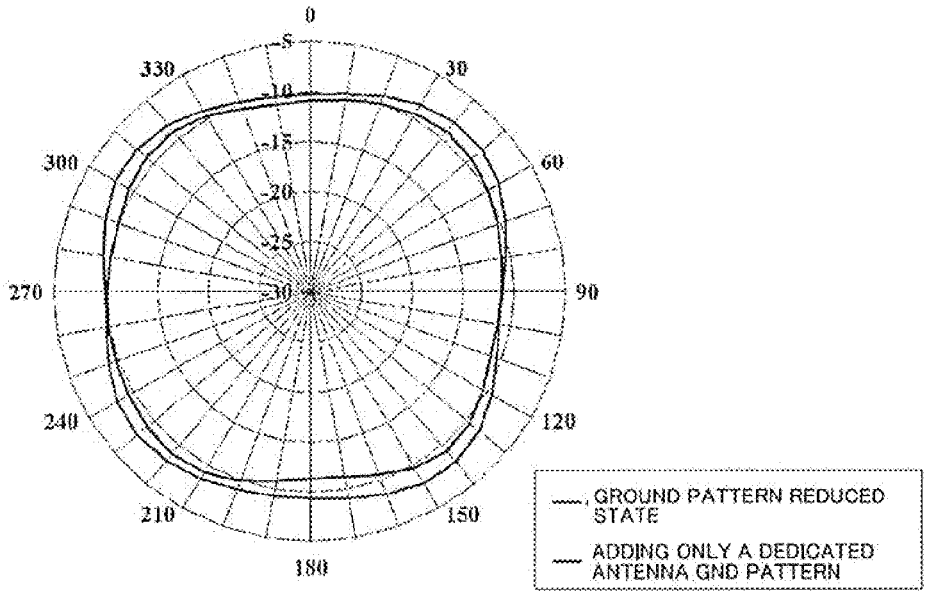
FIG. 15 is a graph that shows the radiation pattern of a conventional example in which the circuit-side ground pattern has been reduced and an example in which a dedicated antenna ground pattern has been added in a conventional example and an embodiment of the antenna device according to the present disclosure.

In addition, as shown in FIG. 14, consider the example of the present invention in which the circuit-side ground pattern 4 remains in a reduced state and the dedicated antenna ground pattern 11 is added. As a result, even when the circuit-side ground pattern 4 remains in a reduced state, as shown in FIG. 15, in comparison to the state in which the circuit-side ground pattern 4 is reduced (GND pattern reduced state), the antenna gain is improved by 1.2 dB. In addition, the bandwidth with a VSWR=3 is improved 6% with respect to the GND pattern reduction state.

Figure 16:
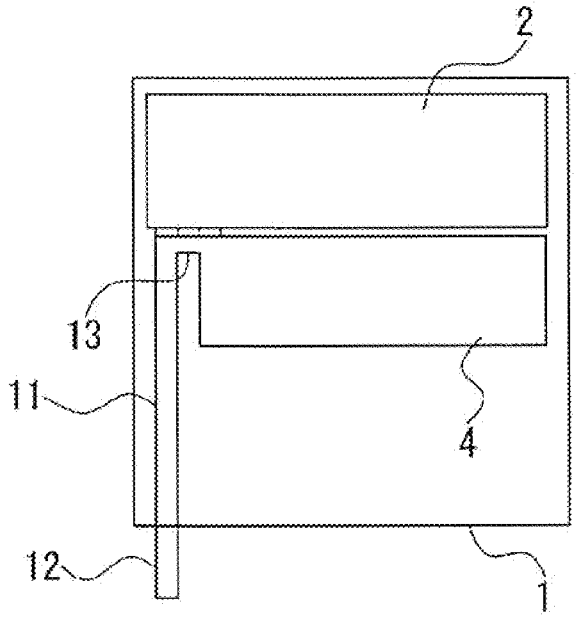
FIG. 16 is a simple plan view that shows the case in which a dedicated antenna ground pattern and a metal component have been added in the example of the antenna device of the present disclosure.
Figure 17:
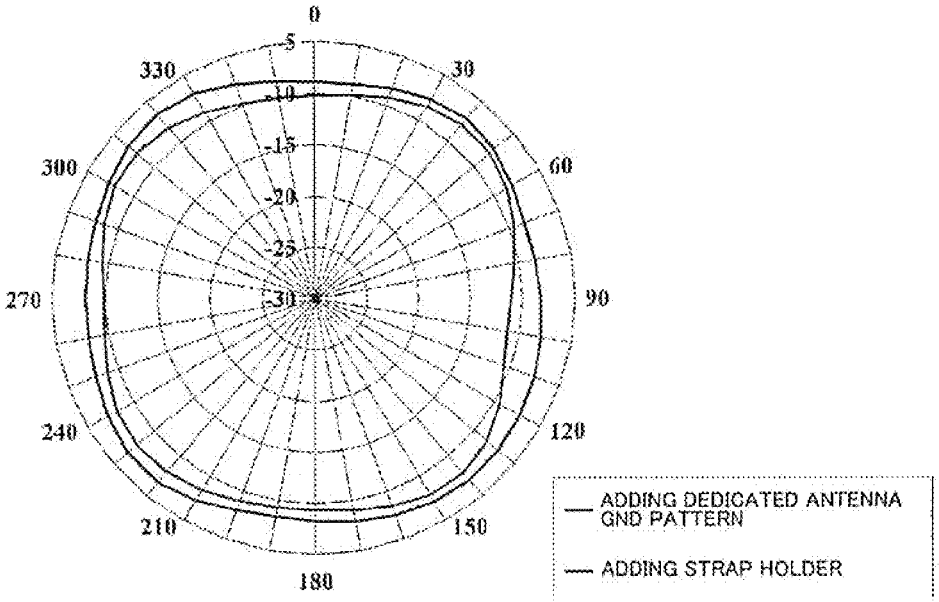
FIG. 17 is a graph that shows a radiation pattern of an example in which a dedicated antenna ground pattern has been added and an example in which a metal component has been added in the example of the antenna device of the present disclosure.
Figure 18:
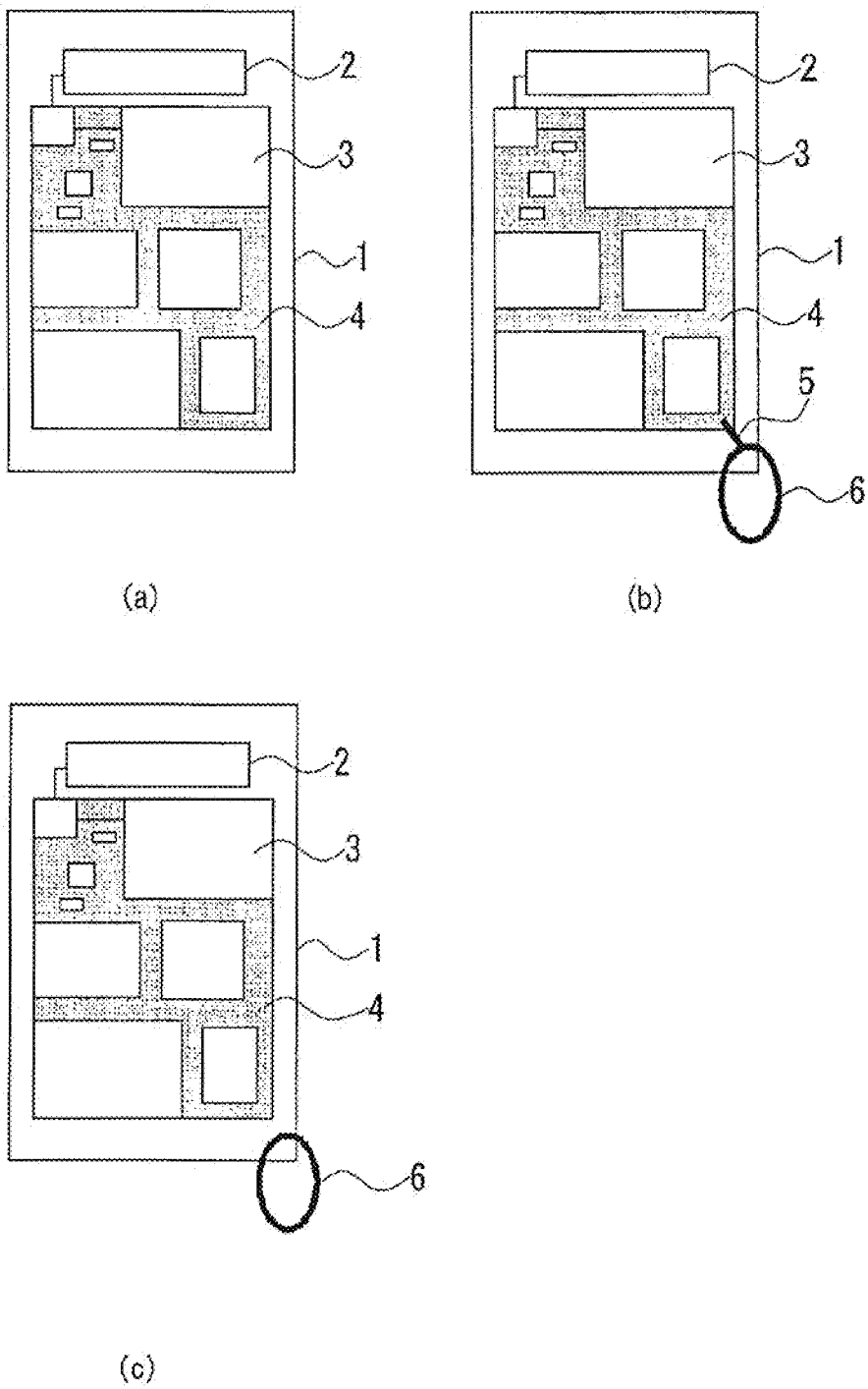
FIG. 18 is a plan view that shows the case in which the circuit-side ground pattern is small, the case in which a circuit-side ground pattern and a hand strap are electrically connected, and the case in which a circuit-side ground pattern and a hand strap are electromagnetically coupled in a conventional example of an antenna device according to the present disclosure.

Next, as shown in FIG. 16, consider an example of the present invention in which a dedicated antenna ground pattern 11 is added, and furthermore, the metal component 12, which is a strap holder, is connected to the dedicated antenna ground pattern 11. As a result, as shown in FIG. 17, in comparison to the above example in which the dedicated antenna around pattern is added, it can be understood that the antenna gain is further improved by 1 dB. In addition, a bandwidth with a VSWR=3 improves 2% for the above example in which the dedicated antenna ground pattern 11 is added. Based on the above results, it could be confirmed that the addition of the dedicated antenna ground pattern 11 and the metal component 12 in the example of the present invention resulted in a significant improvement in properties.

Note that the present invention is not limited by each of the embodiments described above, and various modifications may be added without departing from the spirit of the invention. For example, in each of the above embodiments, a dedicated antenna ground pattern was provided the substrate, but when using a laminated substrate as a substrate, the dedicated antenna ground pattern may be designed as an inner layer pattern or the like located in any of the layers. Note that ideally, the dedicated antenna ground pattern is preferably designed so as to be located at the on the component surface layer of the substrate surface.

What is claimed is:

1. An antenna device comprising:

a substrate:

a wireless circuit component that is provided on the substrate;

an internal antenna that is provided on the substrate and is connected to the wireless circuit component;

a circuit-side ground pattern that is provided on the substrate and is connected to the wireless circuit component; and a dedicated antenna ground pattern that is provided on the substrate and is connected to the internal antenna.

2. An antenna device according to claim 1, wherein the dedicated antenna ground pattern extends in a direction perpendicular to the direction of the extension of the internal antenna.

3. An antenna device according to claim 1, further comprising a metal component that is provided so as to project from the substrate, wherein the dedicated antenna ground pattern is connected to the metal component.

4. An antenna device according to claim 3, wherein the metal component is a strap holder.

5. An antenna device according to claim 3, wherein a static electricity countermeasure circuit component is provided between the metal component and the dedicated antenna ground pattern.

6. An antenna device according to claim 1, further comprising a ground adjustment component that locally connects the dedicated antenna ground pattern and the circuit-side ground pattern at least at one location.

* * * * *